US009184535B2

(12) United States Patent
Tsuchida et al.

(10) Patent No.: US 9,184,535 B2
(45) Date of Patent: Nov. 10, 2015

(54) ELECTRICAL CONNECTOR

(71) Applicant: Hirose Electric Co., Ltd., Tokyo (JP)

(72) Inventors: Masahiro Tsuchida, Tokyo (JP); Takashi Sawai, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 121 days.

(21) Appl. No.: 13/865,616

(22) Filed: Apr. 18, 2013

(65) Prior Publication Data

US 2013/0280948 A1 Oct. 24, 2013

(30) Foreign Application Priority Data

Apr. 19, 2012 (JP) ..... 2012-095603

(51) Int. Cl.

| | |
|---|---|
| ***H01R 12/62*** | (2011.01) |
| ***H01R 13/62*** | (2006.01) |
| ***H01R 4/50*** | (2006.01) |
| *H01R 9/05* | (2006.01) |

(52) U.S. Cl.

CPC ..... *H01R 13/62* (2013.01); *H01R 4/5066* (2013.01); *H01R 4/5075* (2013.01); *H01R 9/0518* (2013.01)

(58) Field of Classification Search

CPC ..... H01R 9/0518
USPC ..... 439/582, 581, 63
See application file for complete search history.

(56) References Cited

U.S. PATENT DOCUMENTS

| | | | | | |
|---|---|---|---|---|---|
| 5,001,615 | A | * | 3/1991 | Stefanelli | 362/655 |
| 5,180,315 | A | * | 1/1993 | Nagashima | 439/581 |
| 5,190,475 | A | * | 3/1993 | Dickens | 439/588 |
| 5,263,877 | A | * | 11/1993 | Mitani | 439/585 |
| 5,288,242 | A | * | 2/1994 | Muzslay | 439/349 |
| 5,482,475 | A | * | 1/1996 | Kawaguchi | 439/394 |
| 5,569,049 | A | * | 10/1996 | Tatebe et al. | 439/394 |
| 5,606,150 | A | * | 2/1997 | Radliff et al. | 174/92 |
| 5,647,775 | A | * | 7/1997 | Polgar et al. | 439/752 |
| 5,662,480 | A | * | 9/1997 | Togashi | 439/63 |
| 5,772,470 | A | * | 6/1998 | Togashi | 439/582 |
| 5,871,374 | A | * | 2/1999 | Maney | 439/596 |
| 5,879,190 | A | * | 3/1999 | Maruyama et al. | 439/582 |
| 5,961,341 | A | * | 10/1999 | Knowles et al. | 439/403 |
| 6,017,241 | A | * | 1/2000 | Komai | 439/419 |
| 6,024,605 | A | * | 2/2000 | Beck, Jr. et al. | 439/595 |

(Continued)

FOREIGN PATENT DOCUMENTS

| | | | |
|---|---|---|---|
| JP | 08-022851 | A | 1/1996 |
| JP | H09-102358 | A | 4/1997 |

(Continued)

*Primary Examiner* — Ross Gushi

(57) ABSTRACT

An electrical connector includes an outer conductive member including a cylindrical member and an outer lid portion for covering the cylindrical member; an insulation member disposed in the outer conductive member; and a terminal disposed in the insulation member. The insulation member includes a main body portion retained in the cylindrical member, a middle lid portion for pressing a center conductive member of a coaxial cable and a cut portion formed between the main body portion and the middle lid portion. The terminal includes a contact portion for contacting with the center conductive member and an engaging portion for engaging with a mating connector, so that the middle lid portion is bent at the cut portion to press the center conductive member against the contact portion when the outer lid portion is bent to cover the cylindrical member and push the middle lid portion.

13 Claims, 11 Drawing Sheets

(56) References Cited

U.S. PATENT DOCUMENTS

| | | | | |
|---|---|---|---|---|
| 6,305,980 | B2 * | 10/2001 | Ko | 439/582 |
| 6,361,383 | B1 * | 3/2002 | Ko | 439/856 |
| 6,371,806 | B1 * | 4/2002 | Ko | 439/585 |
| 6,416,357 | B1 * | 7/2002 | Ko | 439/585 |
| 6,435,907 | B1 * | 8/2002 | Ko | 439/585 |
| 6,435,908 | B1 * | 8/2002 | Ko | 439/585 |
| 6,435,909 | B1 * | 8/2002 | Ko | 439/585 |
| 6,447,335 | B1 * | 9/2002 | Ko | 439/585 |
| 6,503,100 | B2 * | 1/2003 | Yamane | 439/582 |
| 6,508,668 | B1 * | 1/2003 | Yamane | 439/582 |
| 6,559,380 | B2 * | 5/2003 | Soboleski | 174/66 |
| 6,572,407 | B1 * | 6/2003 | Ko | 439/582 |
| 6,649,838 | B1 * | 11/2003 | Lopez et al. | 174/67 |
| 6,712,645 | B1 * | 3/2004 | Chou | 439/582 |
| 6,739,907 | B2 * | 5/2004 | Kuroda et al. | 439/582 |
| 6,790,082 | B2 * | 9/2004 | Obayashi | 439/582 |
| 6,817,899 | B1 * | 11/2004 | Zerebilov | 439/582 |
| 6,837,743 | B2 * | 1/2005 | Ko | 439/582 |
| 6,916,201 | B1 * | 7/2005 | Chu | 439/582 |
| 6,971,913 | B1 * | 12/2005 | Chu | 439/582 |
| 6,997,745 | B2 * | 2/2006 | Ikeda | 439/582 |
| 7,021,966 | B2 * | 4/2006 | Ikeda et al. | 439/582 |
| 7,025,598 | B2 * | 4/2006 | Ikeda | 439/63 |
| 7,025,631 | B2 * | 4/2006 | Yamane | 439/582 |
| 7,351,067 | B2 * | 4/2008 | Chen et al. | 439/63 |
| 7,367,840 | B2 * | 5/2008 | Chen et al. | 439/581 |
| 7,427,204 | B1 * | 9/2008 | Mangone | 439/148 |
| 7,465,191 | B1 * | 12/2008 | Ho | 439/582 |
| 7,467,973 | B2 * | 12/2008 | Lee et al. | 439/582 |
| 7,485,000 | B2 * | 2/2009 | Zeng | 439/582 |
| 7,540,774 | B1 * | 6/2009 | Hung et al. | 439/582 |
| 7,549,868 | B1 * | 6/2009 | Ho | 439/63 |
| 7,704,096 | B2 * | 4/2010 | Liao et al. | 439/582 |
| 7,753,690 | B2 * | 7/2010 | Maruyama et al. | 439/63 |
| 7,762,841 | B2 * | 7/2010 | Ho | 439/582 |
| 7,806,726 | B2 * | 10/2010 | Chen et al. | 439/582 |
| 7,845,990 | B2 * | 12/2010 | Shrum et al. | 439/781 |
| 7,874,870 | B1 * | 1/2011 | Chen | 439/582 |
| 7,938,681 | B2 * | 5/2011 | Lee et al. | 439/582 |
| 7,950,956 | B2 * | 5/2011 | Hiner et al. | 439/521 |
| 7,972,174 | B2 * | 7/2011 | Maruyama et al. | 439/582 |
| 8,047,871 | B2 * | 11/2011 | Kohnishi et al. | 439/582 |
| 8,137,134 | B1 * | 3/2012 | Chang | 439/582 |
| 8,172,613 | B1 * | 5/2012 | Chen et al. | 439/582 |
| 8,262,409 | B2 * | 9/2012 | Chang | 439/582 |
| 8,272,894 | B2 * | 9/2012 | Chiu | 439/582 |
| 8,298,010 | B2 * | 10/2012 | Matsumoto | 439/582 |
| 8,317,540 | B2 * | 11/2012 | Chen | 439/582 |
| 8,414,328 | B2 * | 4/2013 | Yamakoshi et al. | 439/582 |
| 8,475,206 | B2 * | 7/2013 | Kubo | 439/582 |
| 8,512,073 | B2 * | 8/2013 | Takano et al. | 439/578 |
| 8,636,542 | B2 * | 1/2014 | Funahashi | 439/582 |
| 8,668,521 | B2 * | 3/2014 | Sasaki | 439/582 |
| 8,734,179 | B2 * | 5/2014 | Tsai et al. | 439/394 |
| 8,747,153 | B2 * | 6/2014 | Takano et al. | 439/582 |
| 2001/0008816 | A1 * | 7/2001 | Ko | 439/582 |
| 2002/0155755 | A1 * | 10/2002 | Yamane | 439/582 |
| 2002/0187660 | A1 * | 12/2002 | Obayashi | 439/63 |
| 2003/0181100 | A1 * | 9/2003 | Kuroda et al. | 439/582 |
| 2003/0190824 | A1 * | 10/2003 | Ko | 439/63 |
| 2004/0097120 | A1 * | 5/2004 | Limber et al. | 439/369 |
| 2005/0026498 | A1 * | 2/2005 | Ikeda et al. | 439/582 |
| 2005/0032421 | A1 * | 2/2005 | Yamane | 439/582 |
| 2005/0136700 | A1 * | 6/2005 | Ikeda | 439/63 |
| 2005/0136701 | A1 * | 6/2005 | Ikeda | 439/63 |
| 2005/0159022 | A1 * | 7/2005 | Nagata | 439/63 |
| 2006/0094297 | A1 * | 5/2006 | Wang | 439/578 |
| 2007/0082541 | A1 * | 4/2007 | Alloway et al. | 439/492 |
| 2008/0014792 | A1 * | 1/2008 | Chen et al. | 439/581 |
| 2008/0038940 | A1 * | 2/2008 | Chen et al. | 439/63 |
| 2008/0081507 | A1 * | 4/2008 | Mahajan | 439/410 |
| 2008/0096420 | A1 * | 4/2008 | Zeng | 439/582 |
| 2008/0293299 | A1 * | 11/2008 | Liao et al. | 439/582 |
| 2009/0075526 | A1 * | 3/2009 | King et al. | 439/717 |
| 2009/0318021 | A1 * | 12/2009 | Mulfinger et al. | 439/582 |
| 2010/0062639 | A1 * | 3/2010 | Kohnishi et al. | 439/582 |
| 2010/0068927 | A1 * | 3/2010 | Ho | 439/582 |
| 2010/0087091 | A1 * | 4/2010 | Chen | 439/578 |
| 2010/0151729 | A1 * | 6/2010 | Chen et al. | 439/585 |
| 2011/0136378 | A1 * | 6/2011 | Yamakoshi et al. | 439/582 |
| 2012/0295477 | A1 * | 11/2012 | Funahashi | 439/578 |
| 2013/0149897 | A1 * | 6/2013 | Takano et al. | 439/582 |
| 2013/0280948 | A1 * | 10/2013 | Tsuchida et al. | 439/372 |

FOREIGN PATENT DOCUMENTS

| | | | |
|---|---|---|---|
| JP | 2001-307842 | A | 11/2001 |
| JP | 2008-147094 | A | 6/2008 |

* cited by examiner

ELECTRICAL CONNECTOR

BACKGROUND OF THE INVENTION AND RELATED ART STATEMENT

The present invention relates to an electrical connector such as an L-type coaxial connector. More specifically, the present invention relates to an insulation member disposed in an outer conductive member which configures the L-type coaxial connector.

An information device such as a laptop computer, a small electric device such as a mobile phone, and the like is configured to have an internal wiring arrangement using many small coaxial cables. For example, the coaxial cable is downsized so that a connector has a height as low as 1 mm when the coaxial cable is connected to the connector. In addition, the coaxial connectors are configured to have various shapes so that the coaxial cables are connected to a mating connector on a board or other coaxial cable. Commonly, a center conductive member of the coaxial cable is soldered to a central terminal of the coaxial connector in order to establish an electrical connection. However, when the electrical connection is established by the soldering method, it is necessary to implement a soldering process which requires a skilled technique. As a result, it may become difficult to improve productivity.

As one of solutions solving the problem above, Patent Reference 1 has disclosed a conventional coaxial electrical connector (a conventional connector). The conventional connector includes an outer conductive member having a cylindrical connecting portion, a dielectric member retained and held in the cylindrical connecting portion, a central terminal held with the dielectric member and having a connecting portion and a contact portion, and a pressing member for pressing a central terminal placed on a holding surface of the connecting portion.

Patent Reference 1: Japanese Patent Publication No. 2008-147094

In the conventional connector disclosed in Patent Reference 1, the cylindrical connecting portion has an axis in a direction the connector is connected to a mating connector and is opened in one end thereof. The connecting portion of the central terminal is to be connected to a center conductive member of a coaxial cable. The contact portion of the central terminal contacts a mating terminal of the mating connector. The outer conductive member includes a lid portion for covering the cylindrical connecting portion as being bent at a portion thereof next to the cylindrical connecting portion. The outer conductive member of the conventional connector further includes a surrounding portion for holding the coaxial cable after the lid portion is bent. The surrounding portion and the lid portion are formed consecutively.

In the conventional connector disclosed in Patent Reference 1, the center conductive member of the coaxial connector is exposed by removing an end portion of an outer jacket. Then the center conductive member is placed on the holding surface. The holding surface is formed in the connecting portion of the central terminal of the conventional connector. Next, the pressing member receives a pressing force as the lid portion of the outer conductive member is bent. The pressing member receives the pressing force and then presses the center conductive member of the coaxial cable between a pressing surface of the pressing member and the holding surface of the contact portion. Further, at least either of the pressing surface of the pressing member and the holding surface of the contact portion of the central terminal includes a position regulating portion. As a pressing surface presses the center conductive member against the holding surface, the center conductive member is held in a proper position by the position regulating portion. As described above, in the conventional coaxial electrical connector in Patent Reference 1, it is possible to hold the center conductive member in the proper position without the soldering process.

In the conventional connector disclosed in Patent Reference 1, however, when the pressing member is made with a molding material such as a liquid crystal polymer (LCP) resin and the like filled with a filler such as a glass fiber, a carbon fiber, mica and the like, the pressing member may not be bent at a fixed position as the connector is downsized. As a result, the pressing surface of the pressing member may not press the center conductive member of the coaxial cable against the holding surface of the contact portion to the proper position. For example, when the pressing member is molded with the LCP resin and the like filled with the filler, the pressing member may not be bent at a regular position of a bottom portion thereof since the filler is not distributed uniformly at the bottom portion or as the filler exists right in the bottom portion where the pressing member is bent.

In a case described above, the pressing surface of the pressing member of the lid portion shifts from the regular position where the pressing surface correctly overlaps the holding surface of the contact portion. As a result, it is not possible to press the center conductive member of the coaxial cable to the proper position with the sufficient pressing force. Therefore, the coaxial cable may have unstable response in high frequency since impedance thereof is deteriorated.

Patent Reference 2 has disclosed a conventional coaxial plug connector including a shell portion, an inner plug contact, a plug outer conductive member and an insulating lid portion. The insulating lid portion in Patent Reference 2 is situated between the shell portion and the inner plug contact and insulates between the plug outer conductive member and the inner plug contact. Further, the insulating lid portion corresponds to the pressing member in Patent Reference 1. The insulating lid portion covers a dielectric member of a coaxial cable placed in a neck portion of the plug outer conductive member as being closed together with a lid portion of the plug outer conductive member. The insulating lid portion made from an insulating material is connected to an insulator main body through a hinge provided an inner side thereof. The hinge is bent as the insulating lid portion is closed.

Patent Reference 2: Japanese Patent Publication No. 08-022851

When the insulating lid portion is accompanied with the hinge as described above, the hinge has a certain width. Therefore, due to the same reason described above, when the insulator is made with a molding material such as the LCP resin and the like filled with the filler, the insulating lid portion may not be bent at a fixed position of the hinge as being closed. Accordingly, the insulating lid portion may not be bent at a proper position.

In view of the problems described above, an object of the present invention is to provide an electrical connector including an insulation member retained in an outer conductive member and a terminal fixed to the insulation member. The electrical connector of the present invention enables a middle lid portion of the insulation member to be bent consistently at a proper position in a bottom portion thereof as the middle lid portion of the insulation member is bent for pressing a coaxial cable between an inner surface thereof and an upper surface of the terminal without soldering of a center conductive member of the coaxial cable.

Further objects and advantages of the invention will be apparent from the following description of the invention.

SUMMARY OF THE INVENTION

In order to attain the objects described above, according to the present invention, an electrical connector includes an outer conductive member including a cylindrical member and an outer lid portion for covering the cylindrical member. The cylindrical member has an opening for connection to a mating connector. The opening is situated at one end of the cylindrical member in a direction the electrical connector is connected to the mating connector. The electrical connector further includes an insulation member disposed in the outer conductive member. The insulation member includes a main body portion retained in the cylindrical member, a middle lid portion for pressing a center conductive member of a coaxial cable and a cut portion formed between the main body portion and the middle lid portion. The electrical connector further includes a terminal disposed in the insulation member. The terminal includes a contact portion for contacting the center conductive member of the coaxial cable and an engaging portion for engaging the mating connector. When the outer lid portion is bent to cover the cylindrical member and push the middle lid portion, the outer lid portion applies a pressing force to the middle lid portion. Thereby, the middle lid portion is bent at the cut portion to press the center conductive member against a holding surface of the contact portion.

When the middle lid portion is bent toward the contact portion as receiving the pressing force from the outer lid portion, the middle lid portion is always bent at the cut portion. Therefore, it is possible to bend the middle lid portion to a regular position where enables the center conductive member to be pressed and fixed with the sufficient pressing force. Consequently, it is possible to prevent the coaxial cable from disconnection, having unstable response in high frequency and having deteriorated impedance and the like in advance.

DETAILED DESCRIPTION OF THE PREFERRED EMBODIMENTS

Hereunder, embodiments of the present invention will be explained with reference to the accompanying drawings. Components being the same have the same references through all of the drawings for explaining the embodiments, in order to avoid repeated explanations.

Figure 1:
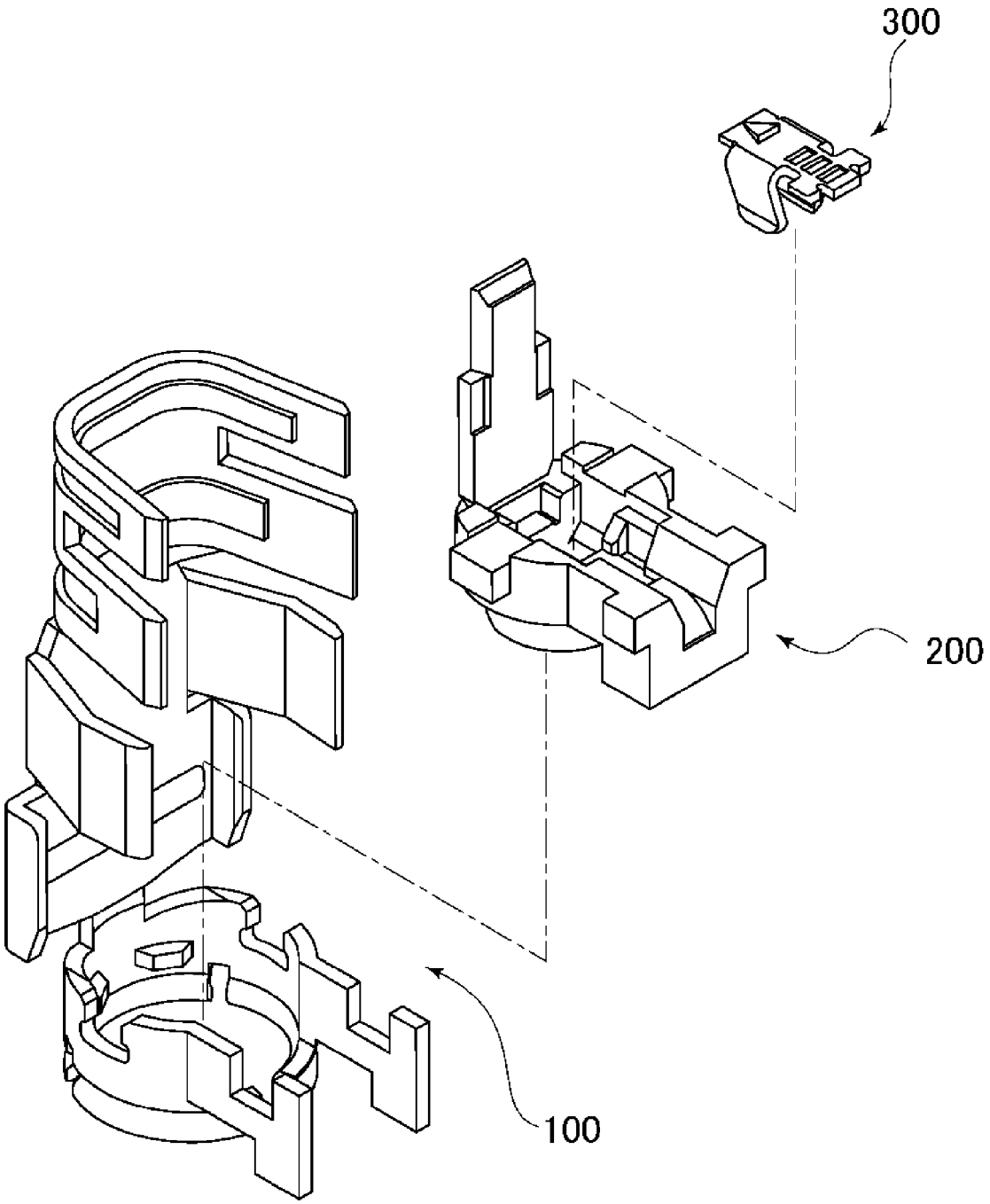
FIG. 1 is a view showing an L-type coaxial connector in a state that the connector is not assembled yet according to an embodiment of the present invention.

FIG. 1 shows an L-type coaxial connector (a connector) according to an embodiment of the present invention in a state that the connector is not assembled, wherein every component of the connector is shown separately. Further, FIGS. 2 to 4(*a*)-4(*b*) show details of the respective components. The connector in the embodiment is to be connected to a mating connector in a direction substantial perpendicular to an extending direction of a coaxial cable (a cable extending direction). The connector includes an outer conductive member 100, an insulation member 200 and a terminal 300. The outer conductive member 100 is electrically connected to a shield line of the coaxial cable (refer to FIGS. 6 to 10). The insulation member 200 is retained in the outer conductive member 100. The terminal 300 is disposed in the insulation member 200 and electrically connected to a center conductive member of the coaxial cable.

Figure 2:
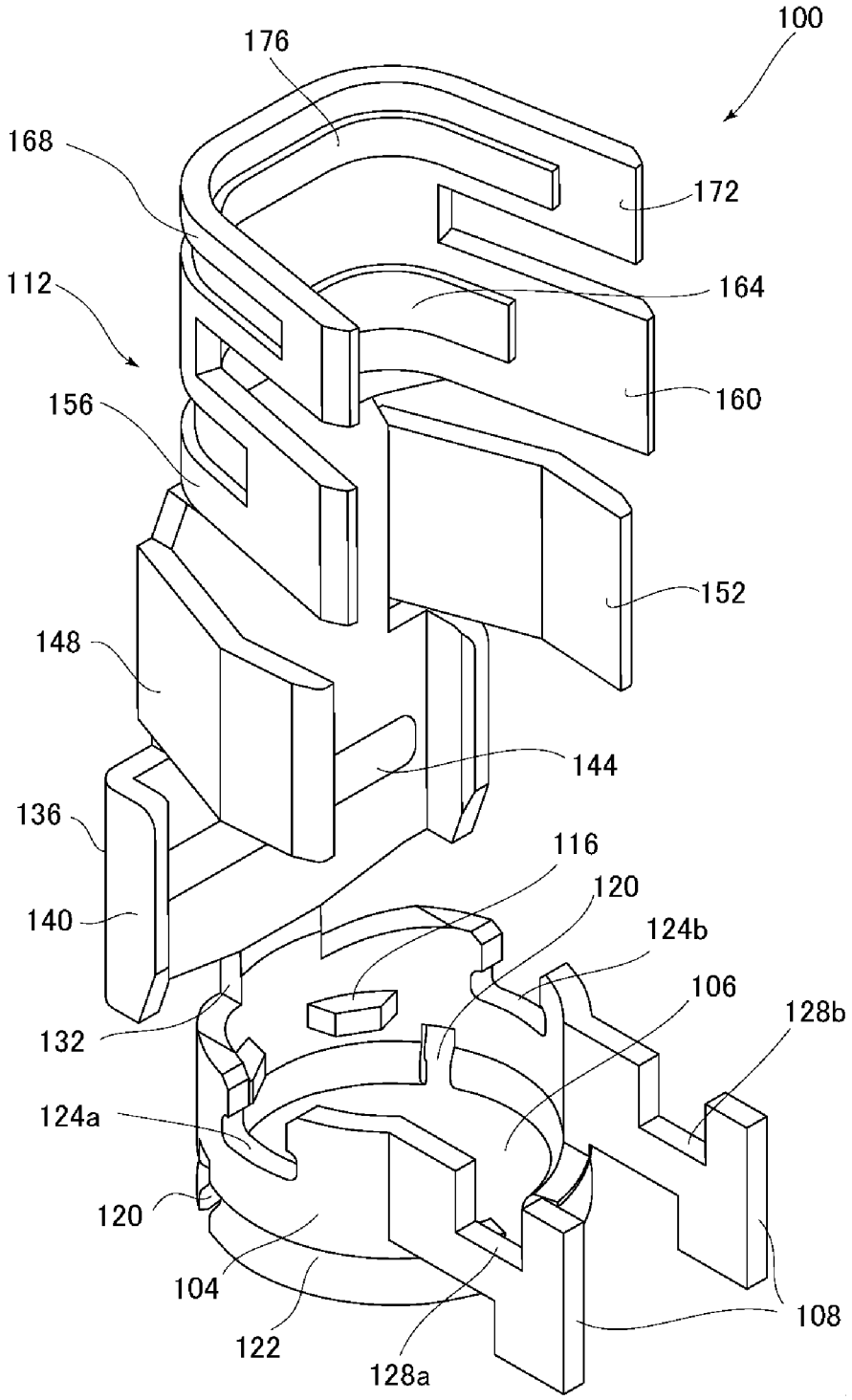
FIG. 2 is a view showing a configuration of an outer conductive member of the L-type coaxial connector before being assembled according to the embodiment of the present invention.

The outer conductive member 100 is made by punching out and bending a metallic plate of a conductive material such as phosphor bronze. As shown in FIG. 2, the outer conductive member 100 is curled so as to have a substantial cylindrical shape. The outer conductive member 100 includes a cylindrical portion 104 having an opening 106 in a circumferential direction and a pair of holding arms 108 extending from positions sandwiching the opening 106. The holding arm 108 extends so as to be parallel with a direction the mating connector is connected (a vertical direction). The outer conductive member 100 further includes an outer lid portion 112 which is situated at an opposite position of the opening 106. The outer lid portion 112 is provided so as to rise from an upper edge of the cylindrical portion 104.

The cylindrical portion 104 retains a main body portion 204 of the insulation member 200 concentrically and includes a protruding placement portion inside thereof for holding the main body portion 204 of the insulation member 200. Further, the cylindrical portion 104 includes a plurality of cutting grooves 120 in the circumferential direction thereof in order to obtain elasticity outward in a radial direction thereof. Furthermore, the cylindrical portion 104 includes engaging portions 124*a*, 124*b* in an upper portion thereof, being arranged in a direction perpendicular to an extending direction of the holding arm 108. In addition, the holding arm 108 includes engaging portions 128*a* and 128*b* in an upper portion thereof. The engaging portions 124*a*, 124*b*, 128*a* and 128*b* engage and hold the insulation member 200 which is forcibly inserted. The cylindrical portion 104 further includes a circular locking groove 122 nearby a lower edge of an outer circumferential surface thereof. The circular locking groove 122 locks the mating connector when the mating connector is connected.

The outer lid portion 112 includes a bending portion 132 having a narrow shape, a flat lid portion 136 for covering the cylindrical portion 104 upon being bent, a fixing portion 148 for covering and fixing the holding arm 108 after being bent. The outer lid portion 112 further includes a shield wire crimping portion 156 and a jacket crimping portion 168. The shield wire crimping portion 156 crimps a shield wire of the coaxial cable in order to establish an electrical connection. The jacket crimping portion 168 crimps an outer jacket of the coaxial cable. When the coaxial cable is connected, the outer lid portion 112 is bent at the bending portion 132 which is connected to the cylindrical portion 104 and covers the coaxial cable.

The flat lid portion 136 includes a lateral portion 140 in both ends thereof. The lateral portion 140 extends in a lower direction when the bending portion 132 is bent. In addition, the flat lid portion 136 further includes a bulging portion 144 made by embossment. The bulging portion 144 is provided on an inner surface of the flat lid portion 136 when the bending portion 132 is bent. The lateral portions 140 are situated with a distance which is equal to or larger than an outer radius of the cylindrical portion 104.

The fixing portion 148 includes a lateral portion 152 in both ends thereof. The lateral portion 152 extends in the lower direction when the bending portion 132 is bent.

The lateral portion 152 contacts an outer surface of the holding arm 108 after the bending portion 132 is bent. Further, the lateral portion 152 is formed to wrap the holding arm 108 downwardly.

The shield wire crimping portion 156 includes a lateral portion 160. The shield wire crimping portion 156 crimps and electrically contacts the shield wire of the coaxial cable after the bending portion 132 is bent. Further, the shield wire crimping portion 156 includes a bulging portion 164 on an inner surface thereof as the bending portion 132 is bent. The bulging portion 164 is made by embossment and prevents the coaxial cable from coming off from the connector when the coaxial cable is pulled in an extending direction thereof.

The jacket crimping portion 168 also includes a lateral portion 172. The jacket crimping portion 168 crimps the jacket of the coaxial cable after the bending portion 132 is bent. Further, the jacket crimping portion 168 includes a bulging portion 176 on an inner surface thereof as the bending portion 132 is bent. The bulging portion 176 is made by embossment and prevents the coaxial cable from coming off from the connector when the coaxial cable is pulled in the extending direction thereof.

Figure 3A:
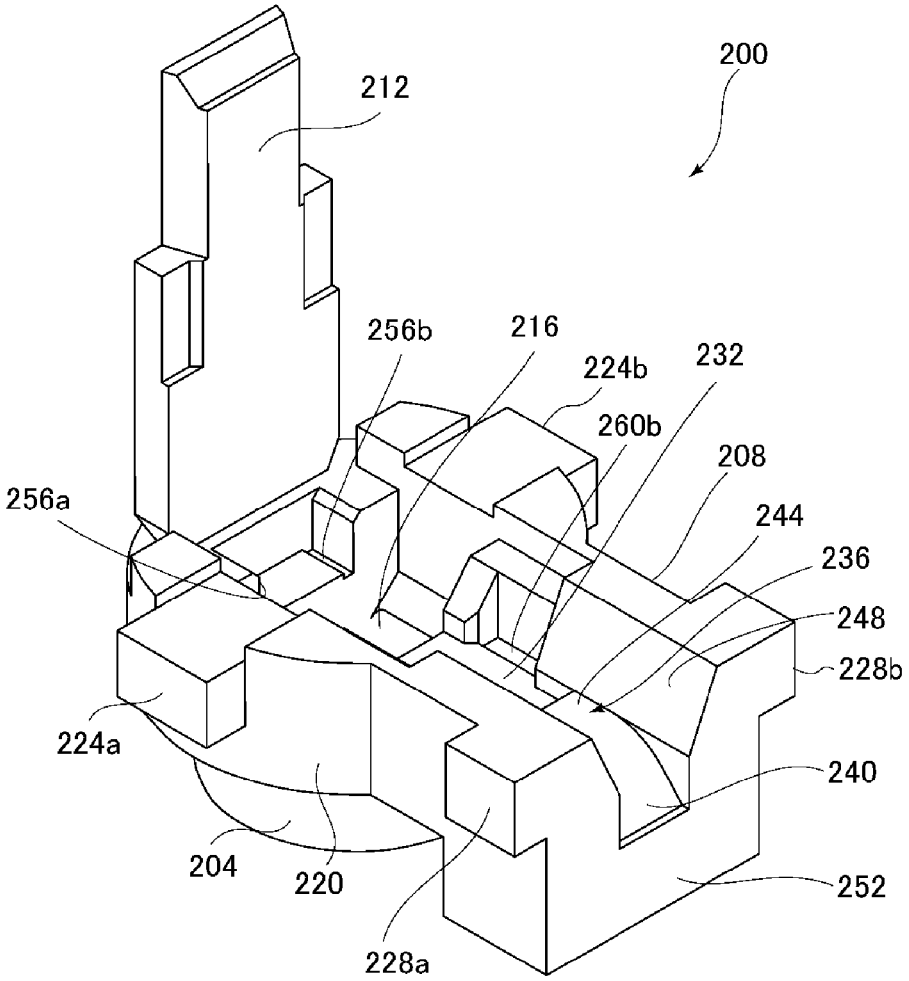
FIGS. 3(*a*) and 3(*b*) are views respectively showing a configuration of insulation member of the L-type coaxial connector before being assembled according to the embodiment of the present invention, wherein FIG. 3(*a*) is a perspective view thereof and FIG. 3(*b*) is a plan view thereof.
Figure 3B:
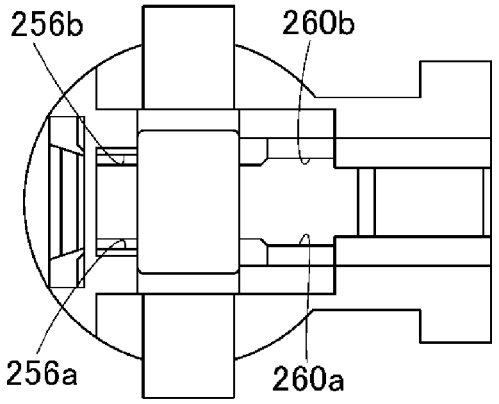

FIGS. 3(*a*) and 3(*b*) are views showing a detailed configuration of the insulation member 200, wherein FIG. 3(*a*) is a perspective view and FIG. 3(*b*) is a plan view. The insulation member 200 is made by molding an insulation material. A heat resistance and flexible material, for example, a liquid crystal polymer (LCP) resin and the like filled with a filler such as a glass fiber, a carbon fiber, mica and the like, is used as the insulation material.

As shown in FIGS. 3(*a*) and 3(*b*), the insulation member 200 includes the main body portion 204 having a substantial cylindrical shape, a shoulder portion 208 extending from an upper portion of the main body portion 204 in the cable extending direction toward outside in a radial direction of the main body portion 204, and a middle lid portion 212 situated at a position opposite to the shoulder portion 208 in a radial direction of the main body portion 204. The middle lid portion 212 extends in the upper direction. The shoulder portion 208 of the insulation member 200 includes a guiding wall 248 having a tilted surface in both sides thereof. The guiding wall 248 guides the middle lid portion 212 when the middle lid portion 212 is bent.

A terminal retaining portion 216 is formed in the main body portion 204 of the insulation member 200 so as to penetrate the main body portion 204 in the vertical direction. The terminal retaining portion 216 has an opening with a substantial rectangular column shape and retains an engaging portion 308 of the terminal 300. The engaging portion 308 has a shape similar to a tongue. Further, a flange portion 220 is formed around an upper circumferential edge of the main body portion 204. Protruding portions 224*a* and 224*b* are formed on both ends of the flange portion 220 in a direction perpendicular to an extending direction of the shoulder portion 208, and the protruding portions 224*a* and 224*b* protrude outward in the radius direction. Furthermore, protruding portions 228*a* and 228*b* are formed on both of upper ends of the shoulder portion 208 in a direction perpendicular to the extending direction of the shoulder portion 208, and the protruding portions 228*a* and 228*b* protrude outward in the radius direction.

The middle lid portion 212 is capable of being bent at a portion connecting to the main body portion 204. The middle lid portion 212 has a length so that a distal end thereof is situated at the same position with a shoulder end surface 252 of the shoulder portion 208 or slightly shorter than the shoulder end surface 252 in the extending direction of the shoulder portion 208 when the middle lid portion 212 is bent completely. In the embodiment, an inside of the middle lid portion 212 stays connected to the main body portion 204 since the middle lid portion 212 is cut from an outside at a cut portion after being bent. In the present invention, the middle lid portion 212 may be separated completely from the main body portion 204 upon being bent.

Figure 4A:
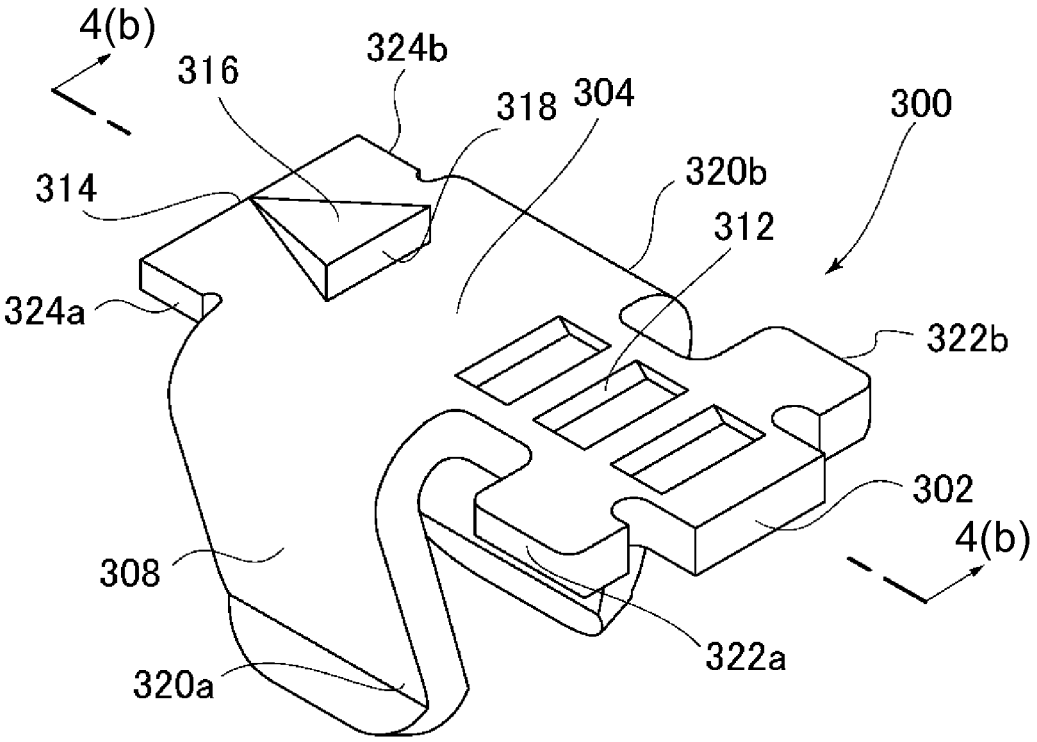
FIGS. 4(*a*) and 4(*b*) are views respectively showing a configuration of a terminal of the L-type coaxial connector before being assembled according to the embodiment of the present invention, wherein FIG. 4(*a*) is a perspective view thereof and FIG. 4(*b*) is a sectional view thereof taken along a line 4(*b*)-4(*b*) in FIG. 4(*a*)
Figure 4B:
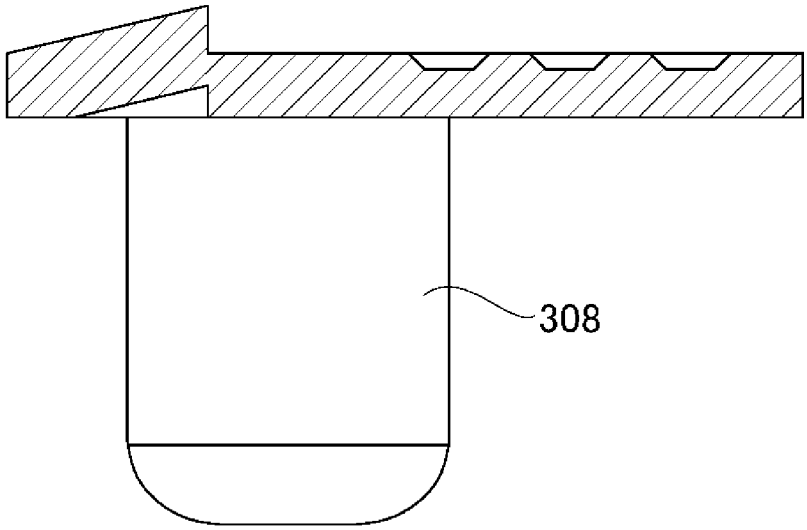

The shoulder end surface 252 of the shoulder portion 208 is situated outside of a cable side end surface 302 (refer to FIG. 4(*a*)) of the terminal 300 in the cable extending direction. The main body portion 204 and the shoulder portion 208 are arranged so as to have a rectangular inner surface extending from where the middle lid portion 212 is connected through the shoulder end surface 252 upon being viewed from a side the coaxial cable is connected. A placement portion 232 is provided in a bottom surface of the rectangular inner surface. The placement portion 232 holds the terminal 300 with a portion thereof situated closer to the terminal retaining portion 216. The placement portion 232 also includes a center conductive member guiding surface 236 on which the terminal 300 is not placed, since the placement portion 232 is longer than where the cable side end surface 302 of the terminal 300 is situated in the cable extending direction. The placement portion 232 further includes a dropped surface 240 at an end portion where the coaxial cable is connected. The dropped surface 240 extends downwardly toward a distal end of the placement portion 232. Furthermore, the center conductive member guiding surface 236 includes a bulging portion 244 bulging in an upper direction. The end portion of the bulging portion 244 also forms the dropped surface 240 partially.

FIGS. 4(*a*) and 4(*b*) are views showing a detailed configuration of the terminal 300, wherein FIG. 4(*a*) is a perspective view thereof and FIG. 4(*b*) is a sectional view taken along a line 4(*b*)-4(*b*) in FIG. 4(*a*). The terminal 300 is made by punching out and bending a metallic plate of a conductive material such as phosphor bronze. Normally, the terminal are bent in a state that a plurality of the same terminals are attached to a carrier with predetermined intervals, for instance, the terminals are bent in a state that the cable side end surface 302 thereof is attached to the carrier. The terminal 300 is assembled into the connector after the cable side end surface 302 is separated from the carrier.

As shown in FIG. 4(*a*), the terminal 300 includes a contact portion 304 for contacting the center conductive member of the coaxial cable to be connected electrically. The terminal 300 also includes an engaging portion 308 for connecting to a mating terminal of the mating connector. Further, the terminal 300 includes push-in portions 322*a*, 322*b*, 324*a* and 324*b* for fitting into terminal engaging portions 256*a*, 256*b*, 260*a* and 260*b* of the insulation member 200.

The contact portion 304 has a substantial flat surface shape extending in the cable extending direction. An upper surface of the contact portion 304 contacts the center conductive member of the coaxial cable and includes an uneven portion 312. The uneven portion 312 is formed with a plurality of concaved portions for engaging the center conductive member so that the coaxial cable does not come off. In addition, the contact portion 304 includes a protruding portion 316 at a vicinity of a middle lid end portion 314 thereof. The middle lid end portion 314 is situated at an opposite side of a direction the substantial flat surface thereof extends.

The protruding portion 316 positions the center conductive member of the coaxial cable and regulates a position of a distal end of the center conductive member of the coaxial cable when the coaxial cable is connected. The protruding portion 316 has a substantial triangular shape having a center conductive member regulating surface 318 as one of edges. The center conductive member regulating surface 318 prevents the distal end of the center conductive member of the coaxial cable from being far inside. A corner situated in the vicinity of the middle lid end portion 314 faces the edge formed by the center conductive member regulating surface 318.

The protruding portion 316 is formed by punching the contact portion 304 from the lower direction. Further, the protruding portion 316 has a tilted surface tilted downwardly from the center conductive member regulating surface 318 to the middle lid end portion 314. The tilted surface has the lowest position at the vicinity of the middle lid end portion 314 and the corner facing the edge formed by the center conductive member regulating surface 318 has the same level with the substantial flat surface of the contact portion 304. In addition, the protruding portion 316 is the widest where the center conductive member regulating surface 318 is situated and is the narrowest at the vicinity of the middle lid end portion 314.

When the protruding portion 316 has a rectangular shape, it is possible to deteriorate strength of the push-in portions 324*a* and 324*b*. However, in the embodiment, the push-in portions 324*a* and 324*b* maintain the strength thereof since the protruding portion 316 has the smallest width and height at the vicinity of the middle lid end portion 314, that is, a vicinity of the push-in portions 324*a* and 324*b*. Therefore, a shape of the protruding portion 316 of the connector of the present invention enables the terminal 300 to maintain the strength thereof as well as to position the distal end of the center conductive member of the coaxial cable.

The protruding portion 316 is not limited to have the substantial triangle shape as shown in FIG. 4(*a*). It is possible to obtain the same effect when the protruding portion 316 may have a similar shape. For example, the protruding portion 316 may have a trapezoid shape. In this case, the trapezoid shape has a first side on the side of the coaxial cable (the center conductive member regulating surface 318) as a lower base and a second side on the side of the middle lid end portion 314 as an upper base. Accordingly, the first side of the trapezoid shape becomes the center conductive member regulating surface 318 that regulates the distal end of the center conductive member, and the second side is situated the vicinity of the push-in portions 324*a* and 324*b*.

As shown in FIGS. 4(*a*) and 4(*b*), the engaging portion 308 includes tongue shape portions 320*a* and 320*b* extending in the lower direction from both ends of the contact portion 304. The tongue shape portions 320*a* and 320*b* come close to each other as extending in the lower direction and have a distance therebetween smaller than a center conductive member of the mating terminal of the mating connector at the closest point thereof. Further, distal ends of the tongue shape portions 320*a* and 320*b* are tilted so that the distance therebetween becomes larger in order to guide the center conductive member of the mating terminal of the mating connector. Upon connecting to the mating connector, elasticity in an inner direction of the tongue shape portions 320*a* and 320*b* is generated as a fitting portion of the center conductive member of the mating terminal of the mating connector pushes the tongue shape portions 320*a* and 320*b*. Thereby, the fitting portion of the mating terminal is held. In the embodiment, the terminal 300 has a female shape. In the present invention, the terminal may have a male shape. In addition, three and more of the tongue shape portions may be provided, not limited to two.

Figure 5:
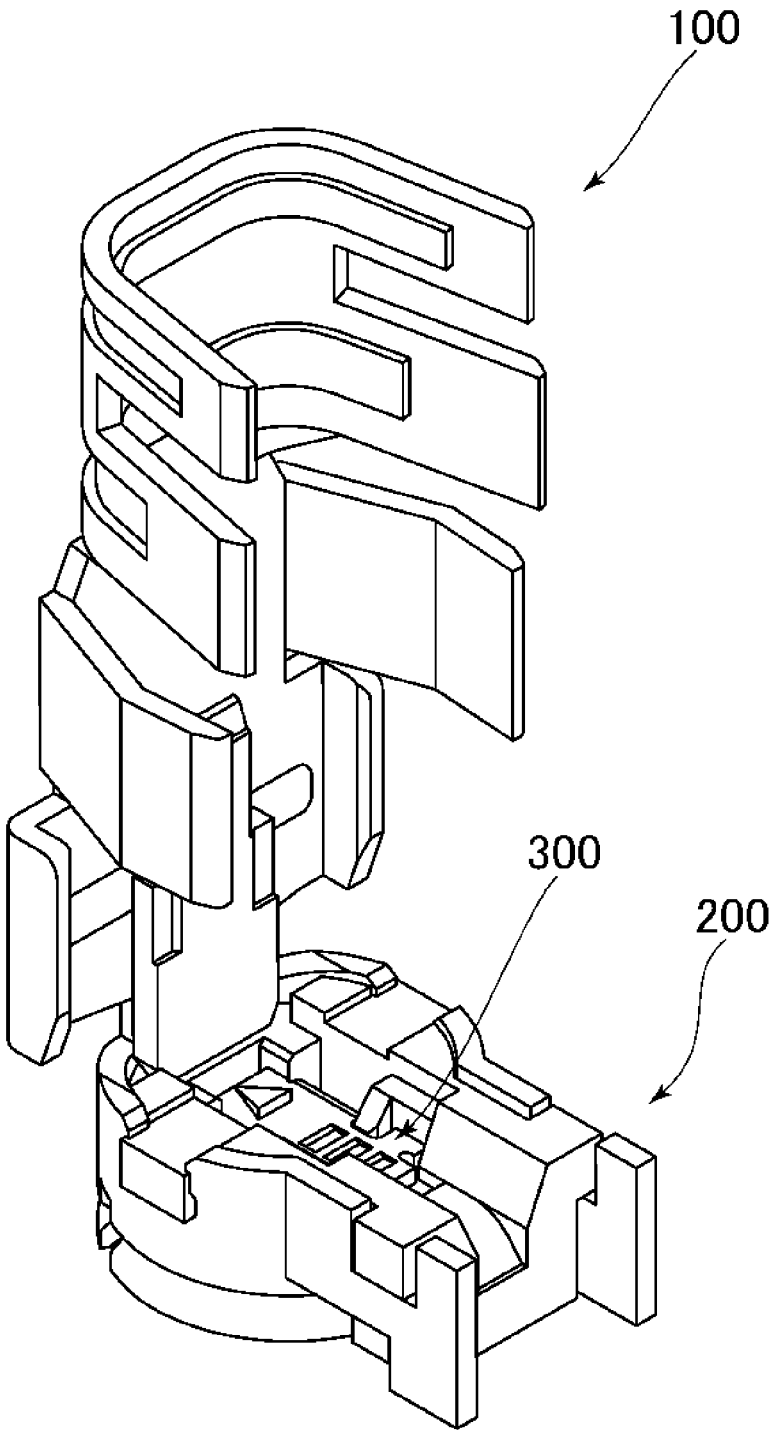
FIG. 5 is a view showing the L-type coaxial connector according to the embodiment of the present invention, in a state of that the insulation member and the terminal are engaged by being forcibly inserted therein.

FIG. 5 shows the connector according to the embodiment of the present invention, in a state that the insulation member 200 and the terminal 300 are assembled therein. The connector is assembled as described below. First, the main body portion 204 of the insulation member 200 is attached into the cylindrical portion 104 of the outer conductive member 100, thereby the protruding portions 224*a*, 224*b*, 228*a* and 228*b* of the insulation member 200 are attached to the engaging portions 128*a* and 128*b* by being forcibly inserted into the engaging portions 124*a* and 124*b* of the outer conductive member 100.

Further, the engaging portion 308 of the terminal 300 is forcibly inserted into the terminal retaining portion 216 of the insulation member 200, so that pressed portions 322*a*, 322*b*, 324*a* and 324*b* are forcibly inserted into the terminal engaging portions 260*a*, 260*b*, 256*a* and 256*b*, respectively. Thereby, a lower surface of the contact portion 304 of the terminal 300 is placed and fixed on the placement portion 232 of the insulation member 200.

Figure 6:
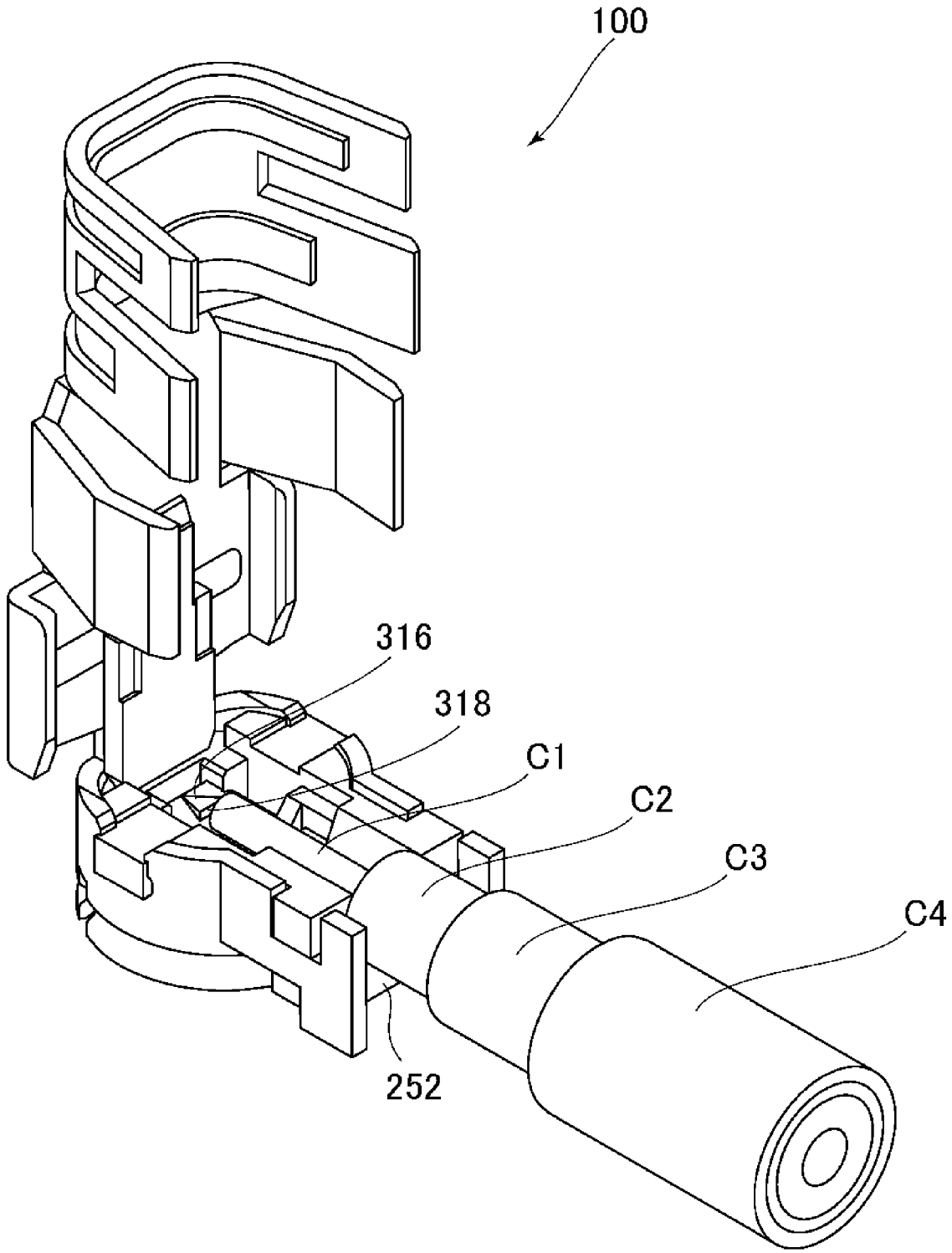
FIG. 6 is a view showing the L-type coaxial connector according to the embodiment of the present invention, wherein a coaxial cable is placed on the insulation member and the terminal.

FIG. 6 is a view showing a state that the coaxial cable is attached to the electrical connector. The coaxial cable is attached to the electrical connector after the terminal 300 is inserted and fixed. The coaxial cable is stripped in three sections with a stripper and the like and exposes in order of the center conductive member C1, a dielectric material C2, a shield wire C3 and the outer jacket C4 at a distal end portion thereof. The center conductive member C1 is placed on the center conductive member guiding surface 236 of the placement portion 232 of the insulation member 200 and the contact portion 304 of the terminal 300 by abutting a cross-sectional surface of the dielectric material C2 of the coaxial cable against the shoulder end surface 252 of the insulation member 200 so that the center conductive member C1 contacts the terminal 300.

When an exposed portion of the center conductive member C1 is too long, the distal end of the center conductive member C1 abuts against the center conductive member regulating surface 318 of the protruding portion 316 while the cross-sectional surface of the dielectric material C2 does not abut against the shoulder end surface 252. Otherwise, the center conductive member C1 is bent. Therefore, it enables an operator to easily find an assembly error.

Figure 7:
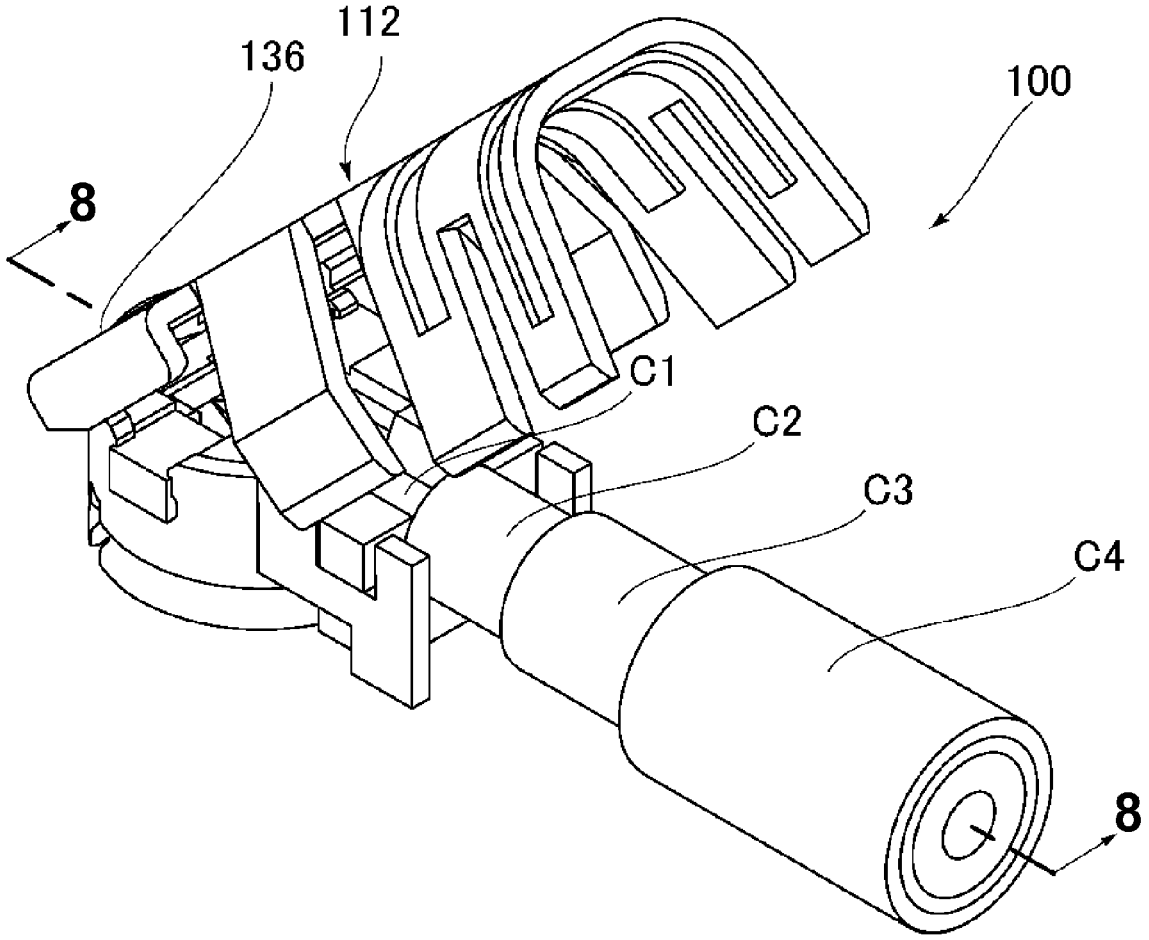
FIG. 7 is a view showing the L-type coaxial connector according to the embodiment of the present invention, in a state that an outer lid portion of the outer conductive member is bent and presses a middle lid portion of the insulation member.
Figure 8:
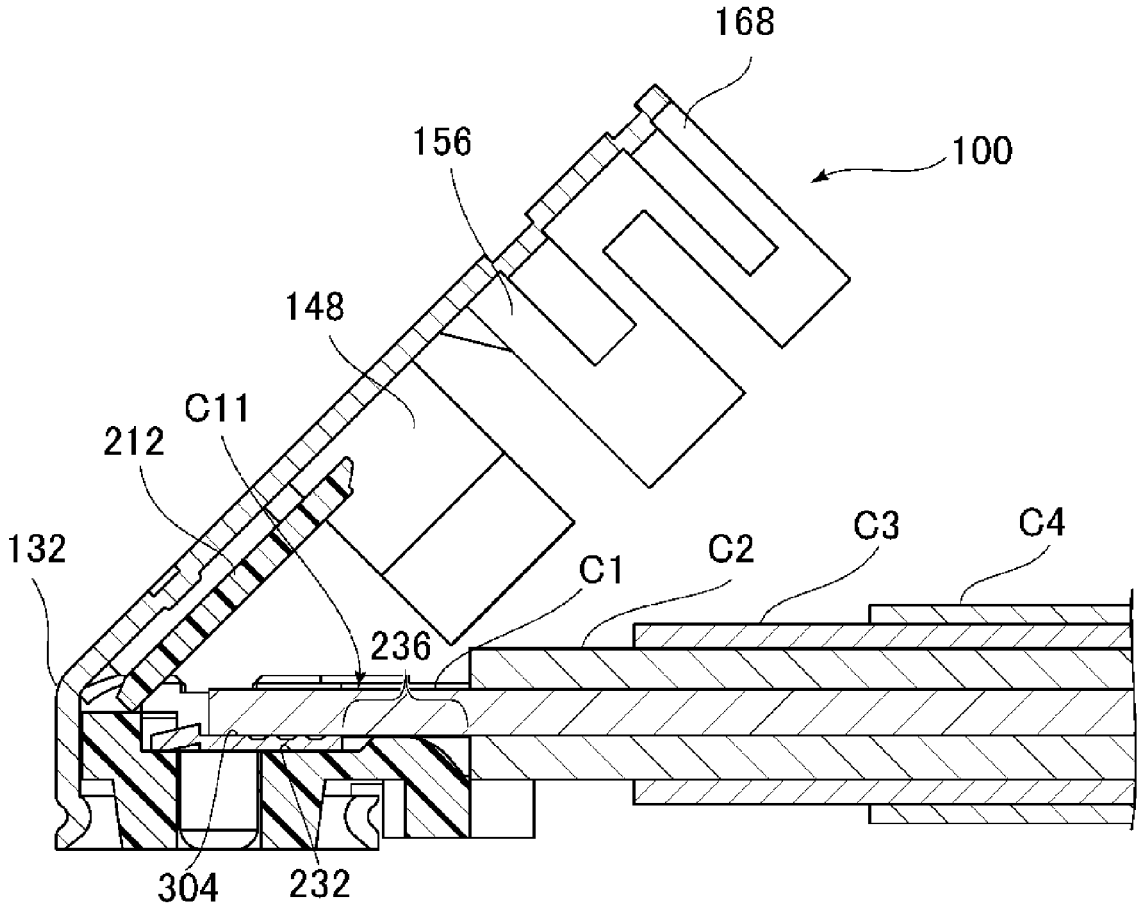
FIG. 8 is a sectional view of the L-type coaxial connector taken along a line 8-8 in FIG. 7, according to the embodiment of the present invention.

FIG. 7 shows a state that the outer lid portion 112 is bent halfway after the center conductive member C1 of the coaxial cable is placed on the contact portion 304. When the outer lid portion 112 is bent, the middle lid portion 212 is bent together with the outer lid portion 112 by receiving a pushing force from the inner surface of the flat lid portion 136 (mainly from the bulging portion 144) of the outer lid portion 112. Further, FIG. 8 shows a sectional view of the connector taken along a line 8-8 in FIG. 7. As shown in FIG. 8, the contact portion 304 of the terminal 300 and the center conductive member guiding surface 236 of the placement portion 232 of the insulation member 200 are situated below an exposed portion C11 of the center conductive member C1. The dielectric material C2, the shield wire C3 and the outer jacket C4 are situated outside of the insulation member 200 in the cable extending direction.

Further, when the outer lid portion 112 (especially the flat lid portion 136) of the outer conductive member 100 is bent as the bending portion 132 thereof is bent so as to cover the cylindrical portion 104, an outer surface of the middle lid portion 212 of the insulation member 200 receives the pushing force from the flat lid portion 136 of the outer conductive member 100. Therefore, an inner surface (a pressing surface) of the middle lid portion 212 and the upper surface (a holding surface for holding the center conductive member C1) of the contact portion 304 of the terminal 300 sandwich the center conductive member C1 of the coaxial cable with the pushing force thus received.

Then, the outer lid portion 112 is fixed by wrapping the holding arm 108 with the fixing portion 148 so that the outer lid portion 112 does not open. Further, the shield wire C3 is crimped by the shield wire crimping portion 156, thereby securing an electrical connection between the shield wire C3 and the outer conductive member 100. Furthermore, the coaxial cable is fixed not to come off from the connector by crimping the outer jacket C4 thereof with the jacket crimping portion 168. As described above, the center conductive member C1 is pressed by being sandwiched. In addition, the shield wire C3 and the outer jacket C4 are crimped, thereby being deformed. On the other hand, the dielectric material C2 is not sandwiched or crimped. Therefore, the dielectric material C2 is not deformed as the coaxial cable is fixed to the connector. As a result, when the cable is connected to the connector, it is possible to minimize change of electrical characters thereof such as impedance.

Figure 9:
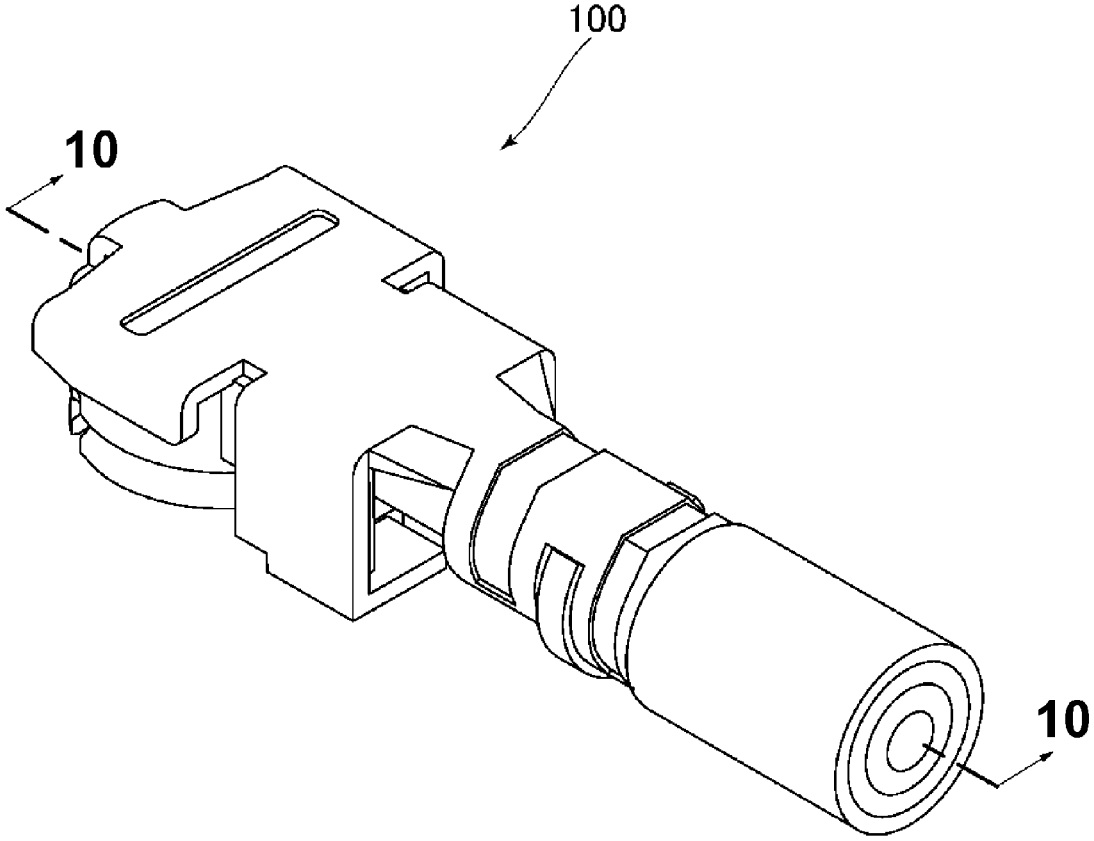
FIG. 9 is a view showing the L-type coaxial connector according to the embodiment of the present invention, in a state that the outer lid portion of the outer conductive member and the middle lid portion of the insulation member are completely closed and fixed.
Figure 10:
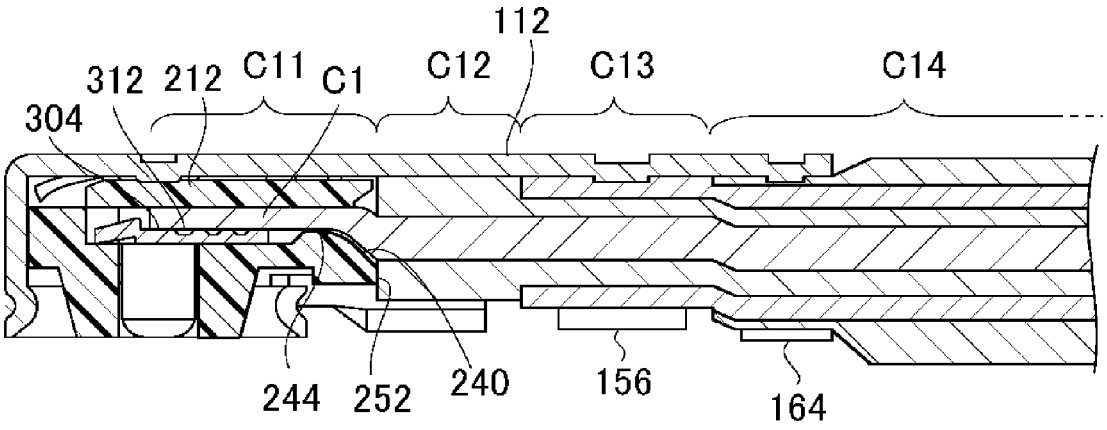
FIG. 10 is a sectional view showing the L-type coaxial connector taken along a line 10-10 in FIG. 9, according to the embodiment of the present invention.

FIGS. 9 and 10 show the connector and the coaxial cable being fixed to each other. FIG. 10 is a sectional view taken along a line 10-10 in FIG. 9. The inner surface (the pressing surface) of the outer lid portion 212 and the upper surface (the holding surface) of the contact portion 304 of the terminal 300 sandwich the center conductive member C1 so as to secure an electrical connection between the terminal 300 and the center conductive member C1.

The center conductive member C1 maintains the electrical connection securely since the uneven portion 312 provided on the upper surface of the contact portion 304 engages the center conductive member C1 so that the center conductive member C1 is able to keep contacting the terminal 300. Further, the center conductive member C1 is held with a sandwiching force generated by the inner surface of the middle lid portion 212 and the bulging portion 244 of the insulation member 200.

The center conductive member C1 is able to secure the electrical connection thereof by a sandwiching force generated by the inner surface of the middle lid portion 212 and the upper surface of the contact portion 304 of the terminal 300. Furthermore, the center conductive member C1 is held with the sandwiching force generated by the inner surface of the middle lid portion 212 and the bulging portion 244. Therefore, it is not necessary to solder the center conductive member to the terminal.

Figure 11:
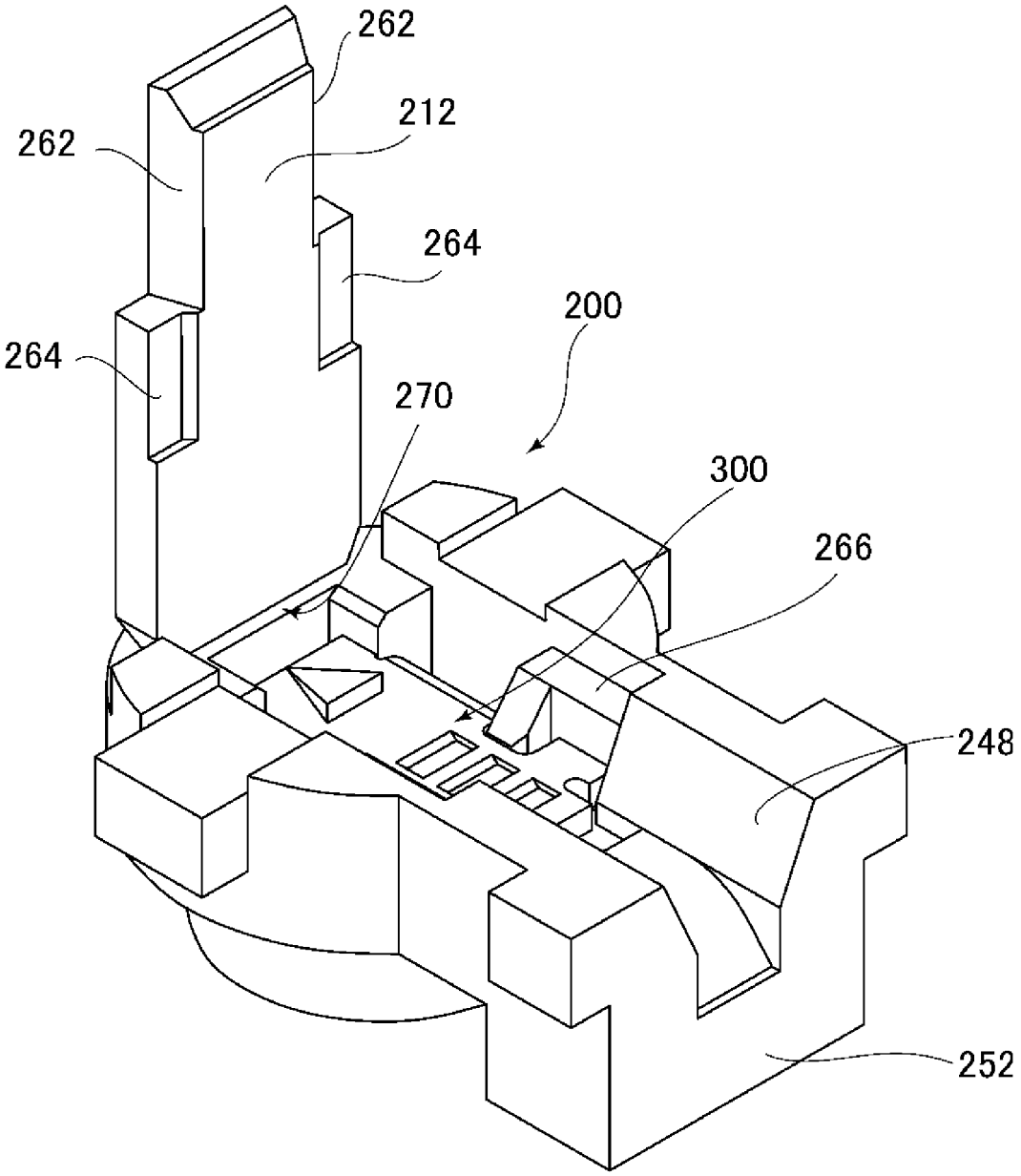
FIG. 11 is a view showing the insulation member wherein the terminal is disposed therein, according to the embodiment of the present invention.

FIG. 11 shows the insulation member 200 in a state that the terminal 300 is attached to the insulation member 200 as the pressed portions 322*a*, 322*b*, 324*a* and 324*b* of the terminal 300 are forcibly inserted into terminal engaging portions 260*a*, 260*b*, 256*a* and 256*b* of the insulation member 200 respectively.

When the outer lid portion 112 of the outer conductive member 100 is bent, the middle lid portion 212 of the insulation member 200 receives a pressing force with the outer surface thereof from the flat lid portion 136 of the outer lid portion 112. Further, the middle lid portion 212 is guided by the guiding wall 248 provided on both inner side surfaces of the shoulder portion 208 with the tilted surface and a distal side surface 262 thereof, so as to be bent to a position for properly fixing the center conductive member C1 (that is, a regular position).

The distal side surface 262 is provided on both side surfaces of the middle lid portion 212. Accordingly, the distal side surface 262 of the middle lid portion 212 faces the guiding wall 248 with or without a small clearance. Similarly, a concaved surface 264 of the middle lid portion 212 faces a convex surface 266 with or without a small clearance. Accordingly, the center conductive member C1 of the coaxial cable is sandwiched between the inner surface of the middle lid portion 212 and the contact portion 304 of the terminal 300.

The insulation member 200 is made with the heat resistance and flexible material. For example, the insulation member 200 is made with a molding material such as the liquid crystal polymer (LCP) resin and the like filled with the filler such as a glass fiber, a carbon fiber, mica and the like.

When the insulation member 200 is made with the LCP resin and the like filled with the filler, the middle lid portion 212 may not be bent at a bottom portion thereof properly as the filler is not distributed uniformly at the bottom portion of the middle lid portion 212 or as the filler exists right in the bottom portion where the middle lid portion 212 is to be bent.

In the case described above, the pressing surface of the middle lid portion 212 shifts from a position where the pressing surface correctly overlaps the holding surface of the contact portion 304 of the terminal 300. Therefore, it is not possible to sandwich the center conductive member C1 of the coaxial cable at a proper position with the sufficient pressing force. As a result, a response of the coaxial cable in high frequency becomes unstable since impedance thereof is deteriorated.

As shown in FIG. 11, the middle lid portion 212 includes a cut portion 270 in the bottom portion thereof so that the middle lid portion 212 is bent at a regular position in order to regularly press the center conductive member C1 against the holding surface of the contact portion 304 at the proper position. The middle lid portion 212 becomes the thinner at the cut portion 270. The cut portion 270 is provided at the bottom portion of the middle lid portion 212. The cut portion 270 has a shape of a groove for being bent easily, having a cross-sectional shape such as a V-letter or a U-letter (that is, a notch) extending in a width direction of the middle lid portion 212. The middle lid portion 212 may have the cut portion 270 at least one of side surfaces of the bottom portion thereof. The cut portion 270 forms the groove with the V-letter cross-sectional shape when the cut portion 270 has a surface tilted with an acute angle and extending along an extending direction of the groove, for example.

Upon being bent toward the contact portion 304 as receiving the pressing force from the outer lid portion 112, the middle lid portion 212 is bent where the cut portion 270 provided for being bent easily is situated. Therefore, it is possible to bend the middle lid portion 212 to the regular position where the center conductive member C1 is sandwiched and fixed sufficiently. The cut portion 270 may be torn at least partially when the middle lid portion 212 is bent to sandwich the center conductive member C1 between the pressing surface thereof and the holding surface of the contact portion 304.

Even when the cut portion 270 is torn partially or entirely, the middle lid portion 212 is fixed by receiving the sufficient pressing force from the outer lid portion 112 (especially, the flat lid portion 136). Further, the concaved surface 264 engages the convex surface 266 and the distal side surface 262 faces the guiding wall 248. As a result, it is possible to regulate the middle lid portion 212 moving laterally with respect to the cable extending direction. Furthermore, the distal end surface of the concaved surface 264 faces an inner end surface on the guiding wall 248 (a surface situated closer to the middle lid portion 212). Therefore, it is possible to regulate the middle lid portion 212 moving in the cable extending direction. Consequently, it is possible to prevent the middle lid portion 212 from moving in the cable extending direction or a lateral direction of the cable extending direction even though the middle lid portion 212 is separated from the insulation member 200.

Furthermore, when the middle lid portion 212 is bent as the cut portion 270 is torn partially, it is possible to prevent the middle lid portion 212 from being bent forcibly at an improper position other than the cut portion 270. In other words, it is possible to bend the middle lid portion 212 correctly at the cut portion. Accordingly, it is preferable that the cut portion 270 is torn partially to that the middle lid portion 212 is bent forcibly in an unintentional direction.

Figure 12:
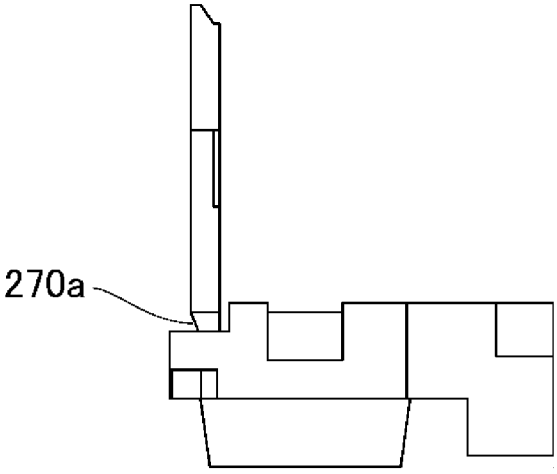
FIG. 12 is a view showing the insulation member having a cut portion on an outside of the middle lid portion thereof, according to another embodiment of the present invention.

FIG. 12 shows another embodiment of the present invention, wherein the middle lid portion 212 of the insulation member 200 includes a cut portion 270*a* facing an opposite direction from the direction the middle lid portion 212 is bent toward the contact portion 304, in other words, an outside of the bottom portion thereof.

Figure 13:
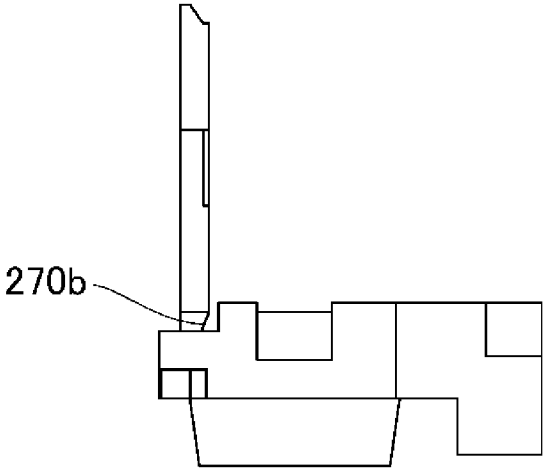
FIG. 13 is a view showing the insulation member having the cut portion on an inside of the middle lid portion thereof, according to another embodiment of the present invention.

Further, FIG. 13 shows another embodiment of the present invention, wherein the middle lid portion 212 of the insulation member 200 includes a cut portion 270*b* facing the direction the middle lid portion 212 is bent toward the contact portion 304, in other words, an inside of the bottom portion thereof.

Figure 14:
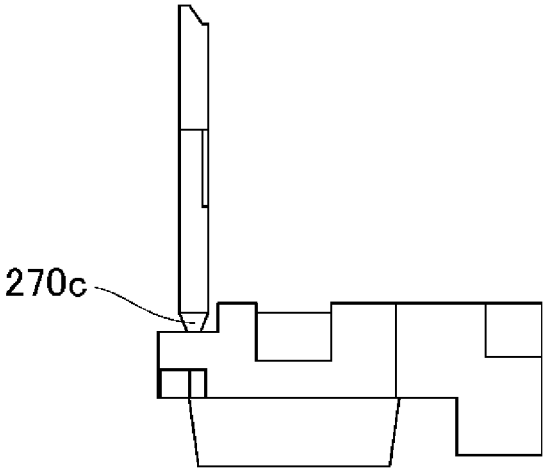
FIG. 14 is a view showing the insulation member having the cut portion on both of the outside and inside of the middle lid portion thereof, according to another embodiment of the present invention.

Furthermore, FIG. 14 shows another embodiment of the present invention, wherein the middle lid portion 212 of the insulation member 200 includes a cut portion 270*c* in both of the outside and the inside of the bottom portion thereof.

Each of the cut portions 270*a*, 270*b* and 270*c* enables the middle lid portion 212 to be bent at the cut portion when the middle lid portion 212 is bent toward the contact portion 304 by receiving the pressing force from outer lid portion 112. Therefore, it is possible to bend the middle lid portion 212 to the regular position capable of fixing the center conductive member C1 sufficiently. In addition, the middle lid portion 212 may include the cut portion not only on the outside or the inside thereof, but also on at least one of side surfaces of the bottom portion thereof. In this case, the cut portion may be provided in a width direction of the side surface. Furthermore, the cut portion is not limited to be provided as described above.

Hereinbefore, the present invention has been explained with the preferred embodiments. It is noted that the present invention is not limited to the embodiments described above and is able to be modified in various ways as long as the essential factor thereof is not deviated from the scope thereof.

An electrical connector such as an L-type coaxial connector is applicable in various ways. For example, in various industries such as a telecommunication device industry and an automotive industry, the L-type coaxial connector is applied to internal wiring of an information device, an electrical device and the like.

The disclosure of Japanese Patent Application No. 2012-095603 filed on Apr. 19, 2012, is incorporated in the application by reference.

While the invention has been explained with reference to the specific embodiments of the invention, the explanation is illustrative and the invention is limited only by the appended claims.

What is claimed is:

1. An electrical connector, comprising:

an outer conductive member including a cylindrical member and an outer lid portion for covering the cylindrical member;

an insulation member disposed in the outer conductive member, said insulation member including a main body portion retained in the cylindrical member, a middle lid portion for pressing a center conductive member of a coaxial cable and a cut portion formed between the main body portion and the middle lid portion; and a terminal disposed in the insulation member, said terminal including a contact portion for contacting with the center conductive member and an engaging portion for engaging with a mating connector so that the middle lid portion is bent at the cut portion to press the center conductive member against the contact portion when the outer lid portion is bent to cover the cylindrical member and push the middle lid portion, wherein said cut portion is configured so that the cut portion is at least partially severed when the middle lid portion is bent at the cut portion to press the center conductive member against the contact portion.

2. The electrical connector according to claim 1, wherein said cut portion is formed at an outside of a base portion of the middle lid portion.

3. The electrical connector according to claim 1, wherein said cut portion is formed at an inside of a base portion of the middle lid portion.

4. The electrical connector according to claim 1, wherein said cut portion is formed at an outside and an inside of a base portion of the middle lid portion.

5. The electrical connector according to claim 1, wherein said cut portion is formed in at least one of a left side surface and a right side surface of a base portion of the middle lid portion.

6. An electrical connector, comprising:

an outer conductive member including a cylindrical member and an outer lid portion for covering the cylindrical member;

an insulation member disposed in the outer conductive member, said insulation member including a main body portion retained in the cylindrical member, a middle lid portion for pressing a center conductive member of a coaxial cable, and a cut portion formed between the main body portion and the middle lid portion; and a terminal disposed in the insulation member, said terminal including a contact portion for contacting with the center conductive member and an engaging portion for engaging with a mating connector so that the middle lid portion is bent at the cut portion to press the center conductive member against the contact portion when the outer lid portion is bent to cover the cylindrical member and push the middle lid portion, wherein said main body portion is formed in a cylindrical shape fitted in the cylindrical member, said main body portion includes a horizontal surface at an edge of the cylindrical shape, said middle lid portion is formed in a rectangular plate shape, said cut portion is formed in a V-notch shape, and said cut portion is attached to the horizontal surface of the cylindrical shape.

7. The electrical connector according to claim 6, wherein said cut portion is formed at an outside of the middle lid portion.

8. The electrical connector according to claim 6, wherein said cut portion is formed at an inside of the middle lid portion.

9. The electrical connector according to claim 6, wherein said cut portion is formed at an outside and an inside of the middle lid portion.

10. The electrical connector according to claim 6, wherein said cut portion is formed in at least one of a left side surface and a right side surface of the middle lid portion.

11. The electrical connector according to claim 6, wherein said cut portion is configured so that the cut portion is at least partially severed when the middle lid portion is bent at the cut portion to press the center conductive member against the contact portion.

12. The electrical connector according to claim 6, wherein said cut portion is configured so that a bottom of the V-notch shape contacts with the horizontal surface of the main body portion.

13. The electrical connector according to claim 6, wherein said main body portion further includes a contact surface situated at a same level as the horizontal surface, and said contact surface is arranged to contact with the middle lid portion when the middle lid portion is bent at the cut portion in a direction perpendicular to the horizontal surface.

* * * * *